United States Patent [19]

Holsiepe et al.

[11] Patent Number: 4,982,905

[45] Date of Patent: Jan. 8, 1991

[54] APPARATUS FOR CRUSHING MATERIALS

[75] Inventors: Dietmar Holsiepe, Ennigerloh; Ludger Lohnherr, Oelde; Hans-Dieter Grudno, Beckum; Bernhard Zigan, Diestedde, all of Fed. Rep. of Germany

[73] Assignee: Krupp Polysius AG, Fed. Rep. of Germany

[21] Appl. No.: 432,169

[22] Filed: Nov. 6, 1989

[30] Foreign Application Priority Data

Nov. 22, 1988 [DE] Fed. Rep. of Germany ..... 3839419

[51] Int. Cl.[5] ..... B02C 23/32

[52] U.S. Cl. ..... 241/79.1; 241/80; 241/81; 241/119

[58] Field of Search ..... 241/117–121, 241/81, 80, 97, 19, 79.1

[56] References Cited

U.S. PATENT DOCUMENTS

| | | | |
|---|---|---|---|
| 1,024,832 | 4/1912 | Cox | 241/81 X |
| 3,934,826 | 1/1976 | Graveman | 241/81 |
| 3,951,347 | 4/1976 | Tiggesbaumker et al. | 241/119 X |
| 3,998,396 | 12/1976 | Umphrey et al. | 241/81 |
| 4,498,633 | 2/1985 | Williams | 241/81 X |

FOREIGN PATENT DOCUMENTS

| | | | |
|---|---|---|---|
| 1414460 | 8/1988 | U.S.S.R. | 241/81 |

*Primary Examiner*—Mark Rosenbaum
*Attorney, Agent, or Firm*—Learman & McCulloch

[57] ABSTRACT

The invention relates to apparatus for delivering material to part of a plant, for example to a crushing and grinding machine, in which the fines are separated out of the feed material passing through the material feed chamber by means of an air stream. In this way a substantial increase in the output of the part of the plant can be achieved.

11 Claims, 1 Drawing Sheet

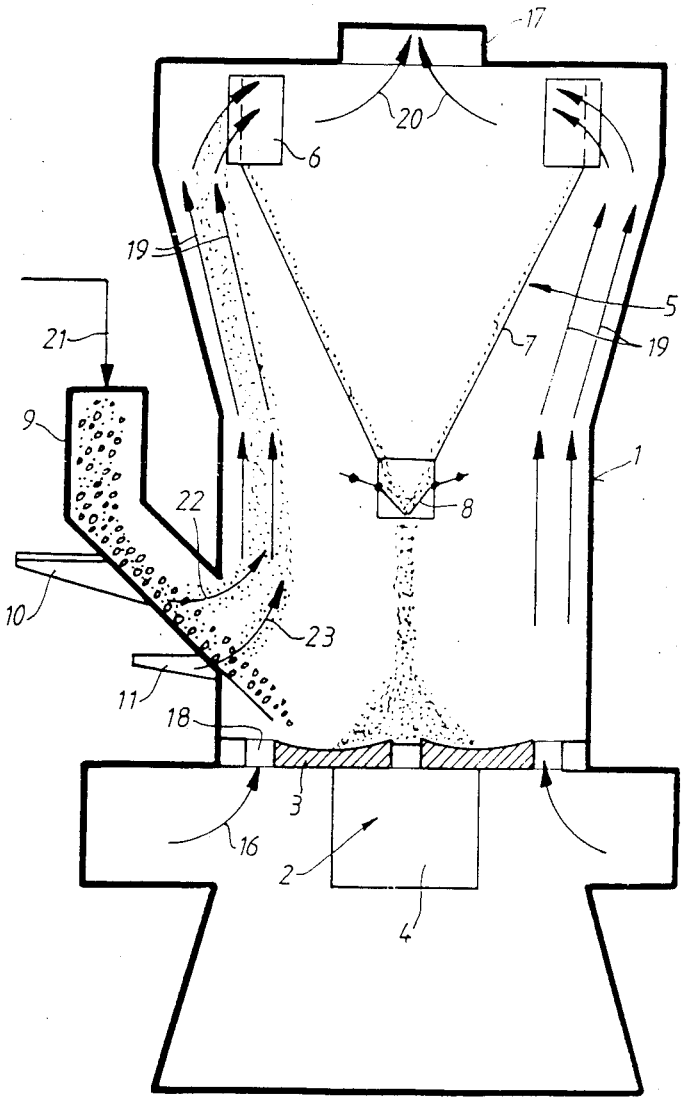
FIG. 1
FIG. 2
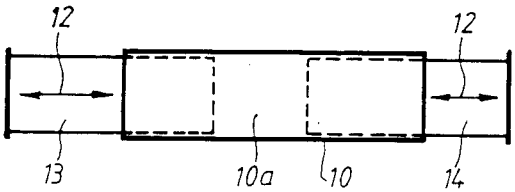
FIG. 3
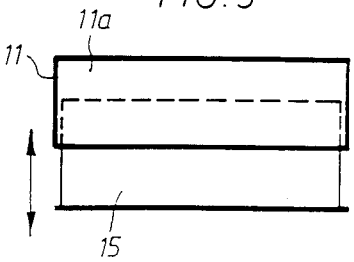

APPARATUS FOR CRUSHING MATERIALS

The invention relates to apparatus for separating the fines of a material from a material stream and for delivering material of differing grain size to part of a plant, particularly a crushing and grinding machine.

BACKGROUND OF THE INVENTION

In crushing and grinding machines, for example roller mills with a separator arranged above, the material to be comminuted is delivered to the grinding chamber via a material feed chamber which is constructed as a chute or shaft and from which all of the material delivered passes into the region of the comminuting devices. However, prior to the grinding stage, this material often includes fines that need not go through the grinding process.

As a rule the material comminuted in the grinding chamber is then delivered pneumatically together with the fines already contained in the feed material to a separator arranged above the mill.

The object of the invention is to construct an apparatus for separating the fines of a material from a material stream in such a way as to achieve a substantial increase in output of the part of the plant, particularly a crushing and grinding machine, arranged after the material delivery apparatus.

SUMMARY OF THE INVENTION

The subject invention is directed toward an apparatus for separating the fines of a raw material from a material stream. The apparatus comprises a crushing stage and a material feed chamber for delivering the raw material to the crushing stage. The apparatus also includes separating means for separating fines resulting from crushing of the material. The separating means include a static separator and means for generating an air stream passing from the crushing stage to the static separator. The apparatus also includes means for generating at least one gas stream passing cross current through the material feed chamber for separating fines from the raw material prior to the crushing stage.

In this way the fines contained in the feed material are separated out of the feed material by means of an air stream before they reach the subsequent part of the plant (for example a crushing and grinding machine) and are delivered to the finished material, bypassing the said part of the plant. In the tests on which the invention is based it was found that in this way increases in output of over 10% could be achieved in roller mills if such air separation of the feed material is used to prevent the fine and very fine particles which actually already belong in the finished material from being ground over again.

Separating out the fine and very fine particles from the feed material also results in a more stable bed of material since a high proportion of very fine particles in the material bed leads to destabilisation of the bed and a reduction in the grinding performance.

The invention can be used advantageously in parts of a plant which operate with negative pressure, in which the air stream which serves for separation of the feed material is drawn in from the surroundings into the material feed chamber.

However, the invention can also be used in parts of a plant which are operated with normal pressure or positive pressure. In this case a fan is used in order to deliver the air stream which serves for separation of the feed material to the material feed chamber.

The part of the plant which is supplied with the pre-separated feed material can be a crushing and grinding machine, for example a roller mill or a high-pressure grinding roll mill. In a roller mill the material feed chamber is generally formed by a material feed chute and in a high-pressure grinding roll mill by a material feed shaft.

According to the invention the part of the plant which is supplied with pre-separated material can also include a static separator. In this case, too, the pre-separation contributes to a considerable easing of the load on the separator, which results in a marked increase in output and an improvement in the selectivity.

THE DRAWINGS

The invention will be described in greater detail below with the aid of the accompanying drawings wherein:

FIG. 1 shows a schematic cross-section through a roller mill with a static separator and a material feed chamber according to the invention.

FIGS. 2 and 3 show plan views of the two air inlet channels and the inlet openings into the material feed chamber.

DETAILED DESCRIPTION

The roller mill which is illustrated schematically in FIG. 1 with an integral separator contains in a housing 1 a crushing stage including roller mill 2 which is shown only schematically with an annular grinding track 3 and drive 4 as well as a static separator 5 with guide vanes 6, tailings cone 7 and flap valve 8.

The separating means also includes means for providing an air stream 16 passing from the crushing stage or roller mill 2 to the static separator 5 to separate the fines of the material after the material has been ground at the grinding stage. The separator means further includes means 10, 11 for providing at least one air stream 22, 23 passing cross-current through the material feed chamber 9 and thus the material stream for separating fines out of the material stream prior to the grinding stage. The means for providing at least one air stream 22, 23 includes at least one air inlet channel 10, 11 in fluid communication with the material feed chamber 9 for providing at least one air stream passing cross current through the material feed chamber 9. More specifically the material to be comminuted is delivered to the roller mill 2 via a material feed chamber or chute 9 to which two air inlet channels 10, 11 may be connected in the region of the base of the inclined lower part of the chute.

The lower inlet openings of these air inlet channels 10 and 11 are provided with slide gates which are shown in detail in FIGS. 2 and 3.

The lower air inlet openings **10*a* of the upper air inlet channel 10 are defined by means of two laterally movable slide gates 13, 14 as indicated by the arrow 12. By adjusting these slide gates 13, 14 it is possible to set not only the size but also the physical position of the effective air inlet opening 10*a***.

The size of the air inlet opening **11*a* of the lower air inlet channel 11 can be adjusted by means of a slide gate 15 which extends over the entire breadth of this air inlet channel 11**.

During operation of the roller mill illustrated in FIG. 1 the gas stream (arrow 16), whichis preferably kiln gas, is drawn in through a nozzle ring 18 by means of a fan connected to the connection 17 of the housing 1 and is passed to the separator 5 (arrow 19) together with the sufficiently comminuted material discharged over the edge of the grinding track 3. In the separator the tailings fall out and are returned to the grinding track via the cone 7 and the flap valve 8, whilst the fines leave the separator through the connection 17 (arrow 20).

According to the invention two air streams which are delivered through the air inlet channels 10 and 11 are draw cross-current through the feed material (arrow 21) passing through the material feed chute 9. The fine and very fine particles contained in the feed material prior to grinding are taken up by these separating air streams (arrows 22, 23) and passed directly to the separator 5 together with the material which has been sufficiently comminuted by the roller mill 2. In this way the fine and very fine particles which have already been separated out of the feed material in the material feed chute 9 do not take the detour via the roller mill but are delivered via the separator 5 directly to the finished material.

We claim:

1. Apparatus for crushing material comprising a housing; means within said housing forming a crushing zone; material feed means having an outlet in communication with said crushing zone for delivering thereto material to be crushed; means for supplying to said feed means raw material to be crushed, said raw material initially containing relatively coarse and relatively fine particles; means for crushing the material delivered to said crushing zone; means forming an air stream for entraining fines resulting from the crushing of said material and conveying them along a path; separator means in said path for separating relatively fine fines from less fine fines; means for discharging the relatively fine fines from said housing; and at least one gas stream independent of said air stream traversing said feed means upstream from said crushing zone and in communication with said air stream for separating relatively fine particles from said raw material and delivering such separated particles to said air stream, those relatively fine particles capable of being entrained by said air stream being combined with said fines and conveyed therewith along said path.

2. Apparatus according to claim 1 wherein said gas stream passes cross-current through said feed means and is created by a negative pressure within said housing.

3. Apparatus according to claim 1 wherein said gas stream passes cross-current through said feed means and is created by a positive pressure from outside said housing.

4. Apparatus according to claim 1 wherein said gas stream communicates with said air stream at the outlet of said feed means.

5. Apparatus according to claim 1 wherein said crushing means comprises a roller mill and said feed means comprises a downwardly extending chute.

6. Apparatus according to claim 1 including another gas stream independent of said air stream and traversing said feed means upstream from said crushing zone and in communication with said air stream for separating further relatively fine particles from said raw material and delivering them to said air stream.

7. Apparatus according to claim 6 wherein said another gas stream passes cross-current through said feed means.

8. Apparatus according to claim 7 wherein said another gas stream is at a level different from that of the one gas stream.

9. Apparatus according to any of claims 1, 6, 7, or 8 wherein said gas stream communicates with said feed means via an inlet, and means for adjusting the size and position of said inlet.

10. Apparatus according to claim 9 wherein said adjusting means comprises a slide gate movable between open and closed positions relative to said feed means for opening and closing said inlet and for adjusting the position at which said gas stream communicates with said feed means.

11. Apparatus as set forth in claim 9 wherein said adjusting means comprises a pair of said slide gates.

* * * * *

UNITED STATES PATENT AND TRADEMARK OFFICE

CERTIFICATE OF CORRECTION

PATENT NO. : 4,982,905

DATED : Jan. 8, 1991

INVENTOR(S) : Dietmar Holsiepe, Ludger Lohnherr, Hans-Dieter Grudno and Bernhard Zigan

It is certified that error appears in the above-identified patent and that said Letters Patent is hereby corrected as shown below:

On the title page:

Change the Abstract to:

Apparatus for separating relatively fine particles from raw material that is to be crushed in a grinding stage has a material feed chamber provided with an outlet for delivering the material to the grinding stage, a static separator, and an air stream passing through a nozzle ring upwardly from the grinding stage to the static separator operable to separate the fines resulting from the grinding stage. At least one air inlet channel is provided for introducing a gas stream cross-current through the material feed chamber and upstream from the grinding stage for separating the relatively fine particles from the raw material prior to the grinding stage.

Column 2, line 68, change "whichis" to -- which is --.

Signed and Sealed this

Seventh Day of July, 1992

*Attest:*

*Attesting Officer*

DOUGLAS B. COMER

*Acting Commissioner of Patents and Trademarks*